US005154456A

United States Patent [19]

Moore et al.

[11] Patent Number: 5,154,456

[45] Date of Patent: Oct. 13, 1992

[54] SECURITY LOCKING BRACKET APPARATUS FOR A PORTABLE COMPUTER

[75] Inventors: Donald E. Moore; Dennis D. Lamberth, both of Houston; Thomas C. Kreiner, Spring, all of Tex.

[73] Assignee: Compaq Computer Corporation, Houston, Tex.

[21] Appl. No.: 721,960

[22] Filed: Jun. 27, 1991

[51] Int. Cl.[5] ..... E05C 1/04

[52] U.S. Cl. ..... 292/162; 70/58; 248/552; 364/708; 292/148

[58] Field of Search ..... 70/58, 67, 68, 69; 248/551, 552, 553; 190/101; 361/394; 364/708; 292/162, 148

[56] References Cited

U.S. PATENT DOCUMENTS

| | | | |
|---|---|---|---|
| 4,047,686 | 9/1977 | Porter | 248/552 |
| 4,556,188 | 12/1985 | Allison, Jr. | 70/58 |
| 4,577,563 | 3/1986 | Sidler | 248/553 |
| 4,603,829 | 8/1986 | Kolke et al. | 70/58 |
| 4,613,109 | 9/1986 | Boscacci | 248/553 |
| 4,672,510 | 6/1987 | Castner | 364/708 |
| 4,712,763 | 12/1987 | Leite | 70/58 |
| 4,738,428 | 4/1988 | Themistos et al. | 70/58 |
| 4,739,637 | 4/1988 | Finkel et al. | 70/58 |
| 4,898,009 | 2/1990 | Lakoski et al. | 70/58 |
| 5,082,233 | 1/1992 | Ayers et al. | 248/553 |

FOREIGN PATENT DOCUMENTS

| | | | |
|---|---|---|---|
| 2153002 | 8/1985 | United Kingdom | 70/58 |

*Primary Examiner*—Eric K. Nicholson
*Attorney, Agent, or Firm*—Konneker & Bush

[57] ABSTRACT

An AC-powerable portable computer has a housing structure with an external opening normally covered by a removable wall releasable interlocked with the housing structure. A security bracket is captively mounted on the housing structure for movement relative thereto between an extended position in which the bracket projects outwardly of the housing structure, and a retracted position in which the bracket projects into the interior of the housing structure and is essentially flush with its exterior surface. The bracket in its retracted position permits the normal removal of the housing wall. However, when the bracket is in its extended position an inner end portion thereof blocks an interior tab portion of the housing wall in a manner preventing its removal. An opening in an outer end portion of the bracket is positioned outwardly of the housing structure when the bracket is its extended position. The locking rod portion of a padlock may be passed through the opening to lock the bracket in its extended position. Alternatively, a locking chain or cable may be passed through the opening and then suitably locked to a table or desk to substantially deter theft of the computer is addition to locking the removable wall on the housing structure.

11 Claims, 3 Drawing Sheets

SECURITY LOCKING BRACKET APPARATUS FOR A PORTABLE COMPUTER

BACKGROUND OF THE INVENTION

1. Field of the Invention

The present invention relates generally to computer apparatus and more particularly relates to security apparatus for inhibiting unauthorized entry into and/or theft of a personal computer.

2. Description of Related Art

Because of their relatively light weight and compact size, unattended personal computers are often prime targets for theft if appropriate security measures are not taken. In the case of desktop personal computers, which are not frequently hand-carried from place to place, a common method of discouraging would be computer thieves is to lock the computer to the desk or table which supports it. A conventional method of doing this is to fixedly secure a pair of commercially available locking brackets to the table (or desk) and to an exterior surface portion of the computer housing (using, for example, an ultrahigh strength epoxy adhesive material), and then lock the two brackets together using a commercially available sheathed security cable.

Since the housing of the typical desktop computer is formed for the most part from a relatively heavy gauge sheet metal material, this security measure has proven to be relatively effective is discouraging computer theft. However, in the case of AC-powerable portable computers it is not nearly as desirable.

This is because the typical portable computer, due to the desirability of keeping its weight low, is customarily provided with a relatively lightweight outer plastic housing—a section of which can be forcibly broken away to free the computer from the security bracket epoxied to its exterior surface. Moreover, the usual external security bracket used for this purpose is rather bulky and forms an unsightly and often inconvenient external projection on the portable computer which can interfere with its carrying ease.

Another problem commonly associated with personal computers relates to securing their interiors against unauthorized entry, and access to their internal operating components, for data theft purposes. This problem is particularly acute in the case of portable computers due to their use of lightweight plastic outer housings which are typically provided with screw-attached cover panels which may be easily and quickly removed to gain access to the interior operating components of the computer.

From the foregoing it can readily be seen that it would be desirable to provide improved portable computer security apparatus for deterring both the theft of and unauthorized entry into the interior of the computer. It is accordingly an object of the present invention to provide such improved security apparatus.

SUMMARY OF THE INVENTION

The present invention provides an improved portable computer that comprises a housing structure having an exterior wall opening therein, and a wall extending across the housing structure opening. First cooperating means on the housing structure and the wall function to removably interlock them, and a security member is captively retained on the housing structure for movement relative thereto between first and second positions.

Second cooperating means on the housing structure and the security member function to lock the removable wall to the housing structure when the security member is in its first position, and to permit the normal removal of the wall from the housing structure when the security member is in its second position. The security member has holding means associated therewith that are usable with an external locking structure, such as a padlock, chain or cable, to selectively preclude movement of the security member from its first position to its second position.

In a preferred embodiment of the computer, the security member is a generally L-shaped bracket member which is slidably carried by the housing structure for movement between a retracted position in which the security member extends into the housing structure and is generally flush with its exterior surface, and an extended position in which the bracket projects outwardly from the housing structure. When the bracket is in its extended position, an angled inner end portion of the bracket is moved behind an inturned tab portion of the removable housing wall and blocks the tab in a manner precluding the normal removal of the wall from the housing structure.

Movement of the bracket to its retracted position shifts its inner end portion away from the tab, thereby permitting the normal removal of the wall from the housing structure. An opening in an outer end portion of the bracket is positioned outwardly of the housing structure when the bracket is in its extended position. This positioning of the bracket opening permits a locking structure, such as the locking rod portion of a padlock, to be extended through the opening, thereby precluding the movement of the bracket to its retracted position. In turn, this locks the housing wall to the housing structure and substantially inhibits unauthorized access to the interior of the computer through the aforementioned housing structure opening.

Alternatively, with the bracket in its extended position, a locking chain or cable member may be passed through the bracket opening and suitably locked to a table or desk which supports the computer. When this locking method is utilized, the bracket functions to lock the removable housing wall over the housing structure opening, and additionally serves as a convenient attachment point for anchoring the computer to a structure such as a table or desk and thereby materially deterring the theft of the computer.

DETAILED DESCRIPTION

Figure 1:
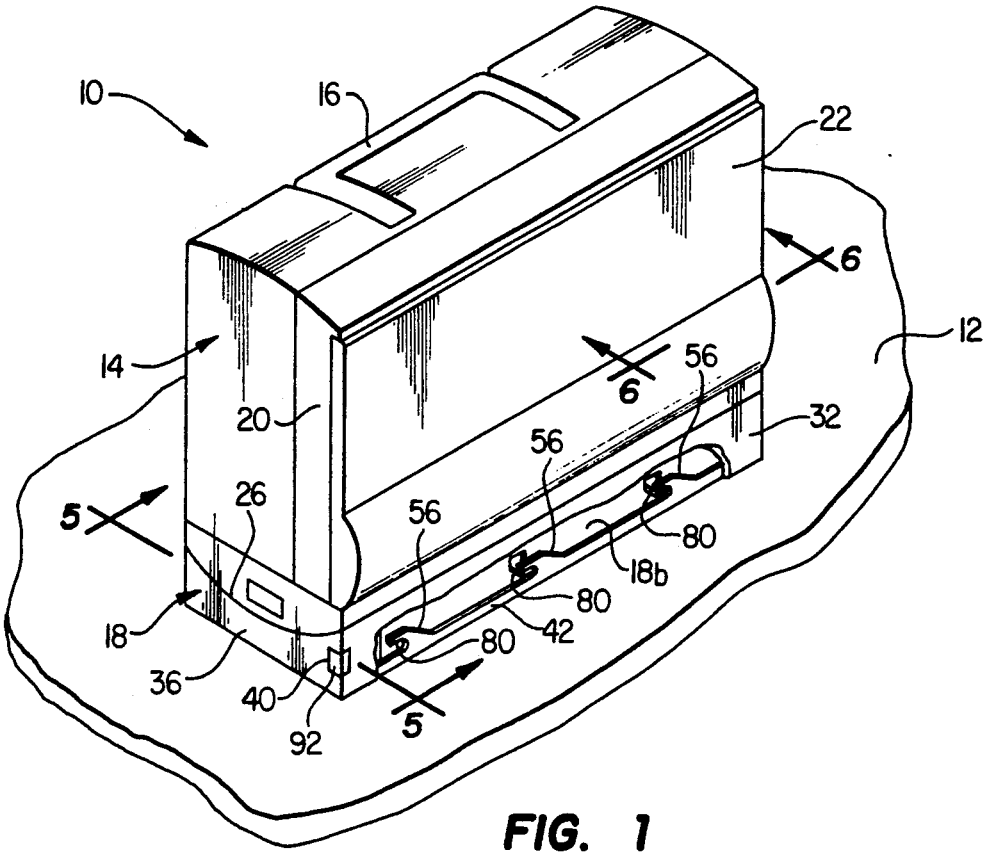
FIG. 1 is a partially cut away front side perspective view of a portable computer having incorporated therein specially designed security locking apparatus embodying principles of the present invention.

Perspectively illustrated in FIG. 1 is an AC-powerable portable computer 10 which embodies principles of the present invention and is supported on the top of a representative table 12. Computer 10 has a plastic upper housing section 14 provided on its top side with a suitable carrying handle 16, a plastic base housing section 18, a display screen housing 20 fixedly secured to the front side of the upper housing section 14, and a keyboard 22 removably latched to the front side of the display screen housing.

Figure 4:
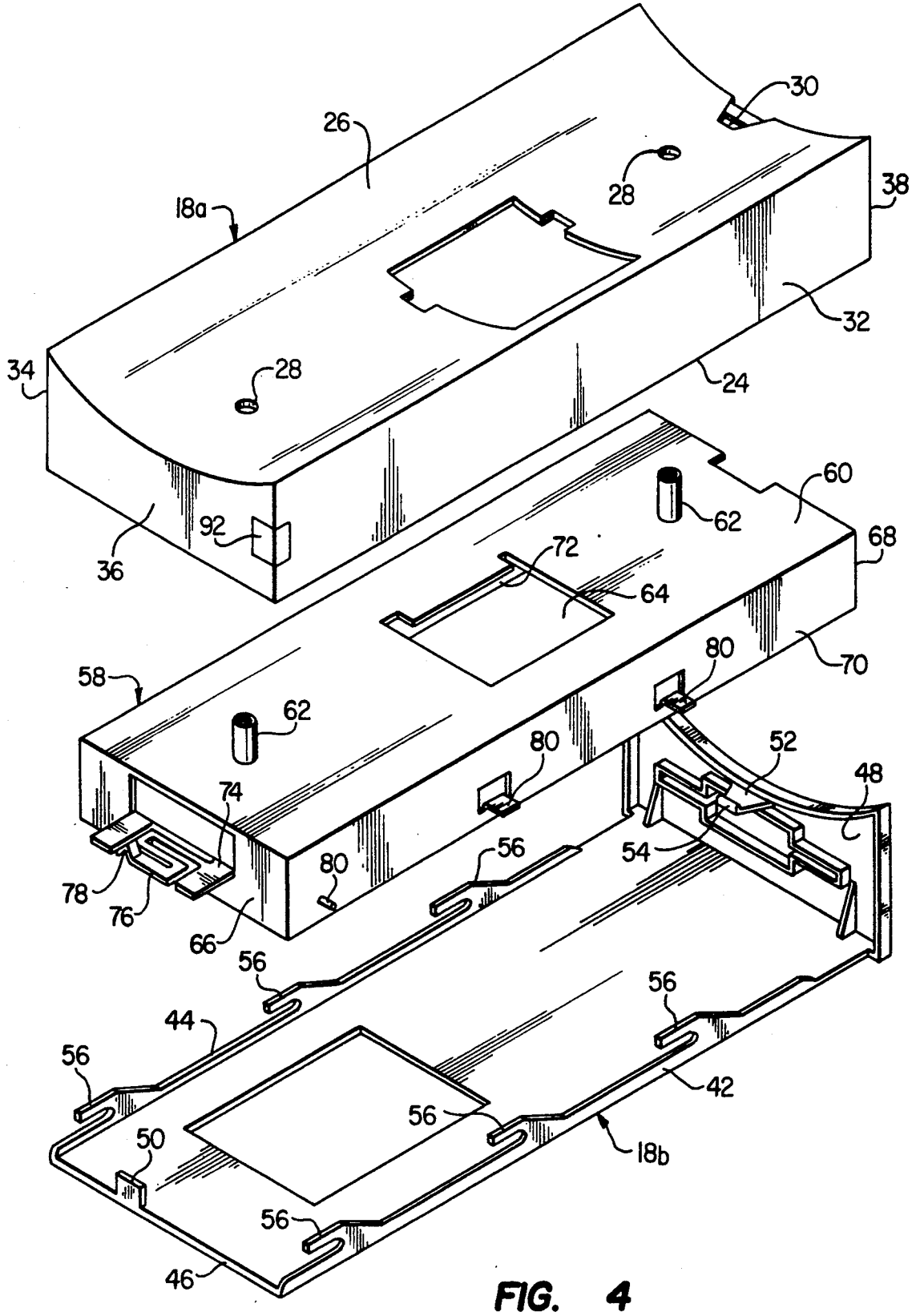
FIG. 4 is an enlarged scale exploded perspective view of a specially designed base portion of the computer.

The base housing 18, as shown in FIG. 4, has an elongated, generally rectangular plastic body 18*a* with an open lower side 24, and an elongated rectangular plastic bottom wall 18*b*. Body 18*a* has a curved top wall 26 in which a pair of mounting openings 28 and a detent opening 30 are formed, front and rear side walls 32 and 34, a left end wall 36, and an open right end 38. For purposes later described, a rectangular area 40 is formed through a left front corner portion of the body 18*a*.

Bottom wall 18*b* has front and rear side edges 42 and 44, a left end edge 46, and an upturned right end portion 48. A rectangular retaining tab 50 projects upwardly from the left end edge 46, and a detent tab 52 projects leftwardly from a central portion of the top edge of the right end wall 48. As illustrated, the tab 52 has an upturned outer end portion 54. Spaced along the length of each of the side edges 42, 44 are three upwardly projecting, leftwardly bent retaining hook portions 56.

An elongated rectangular sheet metal chassis structure 58 (FIG. 4) is disposed within the assembled base housing 18 and houses the disc drives and other operating components (not shown) of the computer 10. Chassis 58 has a top wall 60 with upwardly projecting hollow connections posts 62 thereon, a bottom wall 64, left and right end walls 66 and 68, and front and rear side walls 70 and 72. A rectangular tab portion 74 projects outwardly from end wall 66 and has a detent strip portion 76 with a generally triangularly shaped upward projection 78 on its left end. For purposes later described, three small spaced apart external projections 80 are formed on each of the chassis side walls 70, 72 adjacent its bottom edge.

In assembling the base housing 18, the sheet metal chassis 58 is inserted upwardly into the housing body 18*a* so that the hollow posts 62 enter the top wall openings 28. Retaining screws (not shown) are then threaded into the open upper ends of the posts 62 to captively retain the chassis within the housing body portion 18*a*. With the upturned bottom wall end portion 48 rightwardly offset from the open right end 38 of the housing body 18*a*, the retaining hook portions 56 are positioned inwardly adjacent the housing body side walls 32 and 34 to the right of the chassis side wall projections 80.

Figure 7:
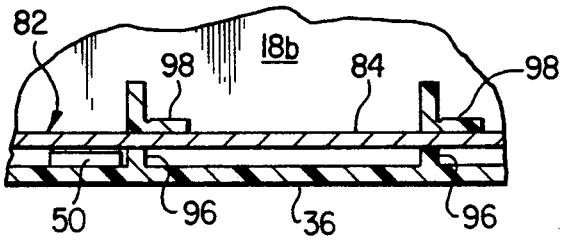
FIG. 7 is a partial cross-sectional view through the computer taken along line 7—7 of FIG. 5A.
Figure 6:
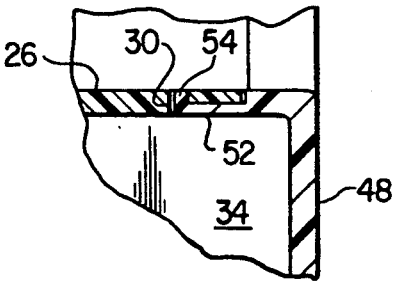
FIG. 6 is an enlarged scale partial cross-sectional view through the computer taken along line 6—6 of FIG. 1.

The bottom wall 18*b* is then moved upwardly to position the retaining hook portions 56 within the housing body 18*a*. Finally, the bottom wall 18*b* is moved leftwardly to engage the hooks 56 with the chassis projections 80 as shown in FIG. 1, and to snap the upturned end 54 of detent tab 52 upwardly into the top housing body wall opening 30 as shown in FIG. 6. This positions the bottom wall left end tab 50 inwardly adjacent the left end wall 36 of the housing body 18*a* as may be best seen in FIG. 7. To remove the installed bottom wall 18*b* from the base housing body portion 18*a* it is necessary to push the bottom wall 18*b* rightwardly, to disengage the wall hooks 56 from the chassis projections 80, and move the tab projection 54 out of the top wall opening 30, and then pull the bottom wall 18*b* downwardly apart from the housing body portion 18*a*.

As will now be described, the present invention provides the computer 10 with a specially designed locking system which may be uniquely used to simultaneously perform two security functions—namely, providing on the computer a mechanical locking attachment point which may be used to anchor the computer to the table 12, and internally locking the bottom housing wall 18*b* to the base housing body 18*a* to inhibit unauthorized entry into the internal chassis 58.

Figure 2:
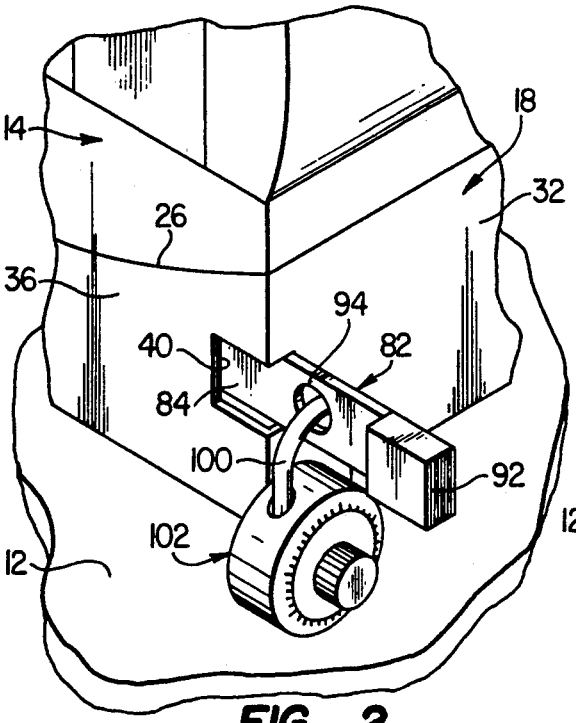
FIG. 2 is an enlarged scale perspective view of a lower left front corner portion of the computer illustrating the use of a locking bracket portion of the security apparatus.
Figure 5A:
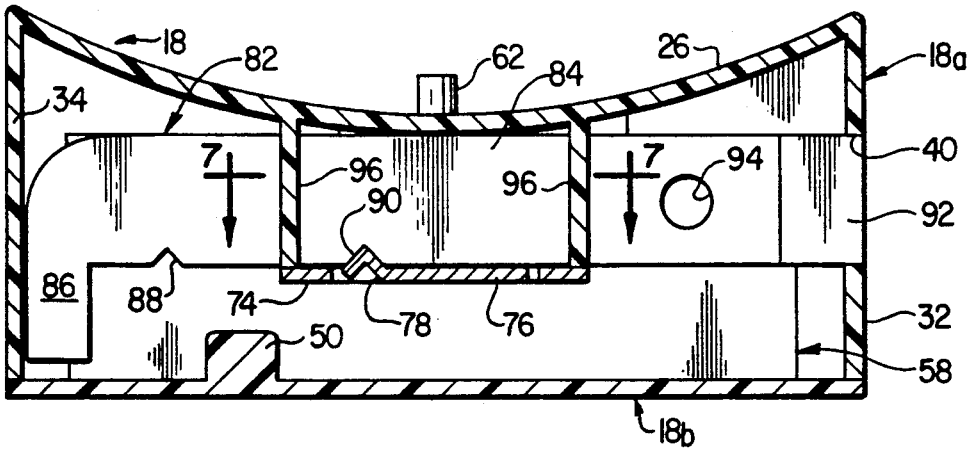
FIGS. 5A and 5B are enlarged scale cross-sectional views taken through the computer along line 5—5 of FIG. 1 and respectively illustrate the locking bracket in retracted and extended positions thereof.

Referring now to FIGS. 2 and 5A, in a preferred embodiment thereof the locking system of the present invention includes a generally L-shaped metal locking bracket 82 having an elongated body 84 with a relatively thin, vertically elongated rectangular cross-section. Body 84 has a downturned inner end 86, a longitudinally spaced pair of triangular notches 88 and 90 formed in its lower side edge, a plastic pull tab member 92 secured to its outer end, and a circular aperture 94 positioned just inwardly of the pull tab member.

Figure 5B:
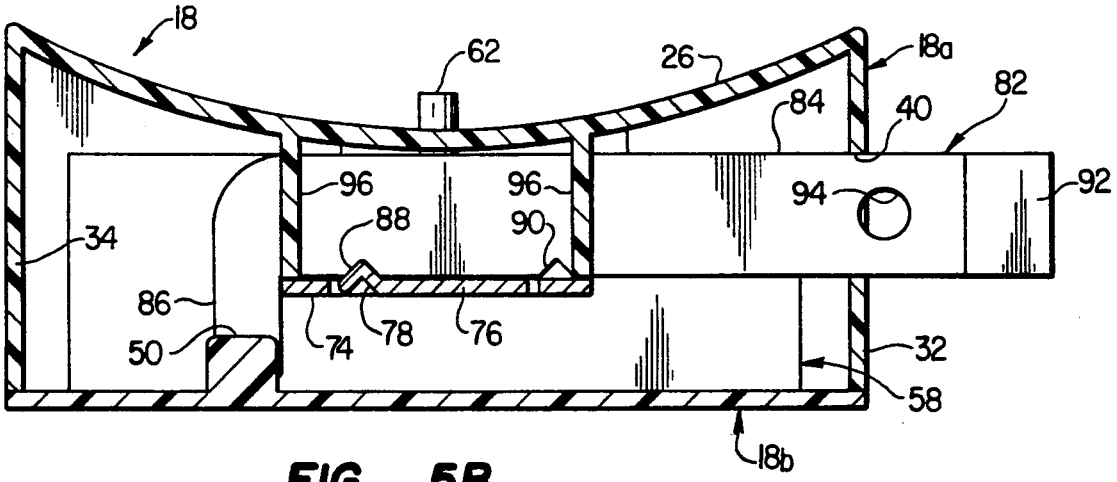

The locking member body 84 extends inwardly through the housing corner cutout area 40 and is disposed above the chassis end tab 74. Two opposed pairs 96, 98 of downwardly extending guide projections formed on the underside of the base housing top wall 26 slidably support the bracket body 84 for horizontal movement relative to the base housing between a retracted release position (FIG. 5A) and an extended locking position (FIG. 5B). As viewed in FIG. 7, the slidably supported bracket body 84 is positioned just inwardly (i.e., rightwardly as viewed in FIG. 4) of the upturned lower housing wall retaining tab 50.

When the retaining bracket 82 is moved to its retracted position shown in FIGS. 1 and 5A, the outer end of the bracket body (including the pull tab 92) is neatly received within the corner cutout area 40 and is essentially flush with the exterior surfaces of the base housing walls 32 and 36. The upturned end portion 78 of the metal detent strip 76 is received in the right bracket body notch 90 and functions to resiliently latch the bracket in its retracted position. Additionally, as viewed in FIG. 5A, the downturned left end 86 of the bracket body 84 is spaced leftwardly apart from the bottom housing wall tab 50, thereby permitting normal removal of the bottom wall 18*b* from the housing body 18*a*.

Referring now to FIGS. 2 and 5B, when the bracket 82 is pulled outwardly to its extended locking position the bracket body aperture 94 is positioned forwardly apart from the base housing front wall 32, the downturned bracket body end portion 86 is brought into abutment with the chassis tab 76 and is positioned directly behind the upturned wall tab 50 (see FIG. 5B), and the detent strip end projection 78 snaps upwardly into the left bracket notch 88 to releasably latch the bracket in its extended position. The generally U-shaped bar portion 100 of a padlock 102 (FIG. 2) may be passed through the bracket aperture 94 and snapped shut.

The securement of the padlock 102 to the bracket 82 in this manner prevents the bracket 82 from being moved an appreciable distance from its extended position toward its retracted release position, thereby locking the downturned bracket end portion 86 in its FIG. 5B position directly behind the upturned bottom housing wall tab 50.

In this position, the bracket end portion 86 prevents the endwise movement of the bottom housing wall 18*b* relative to the housing body 18*a* necessary to effect the removal of the wall 18*b*. The bracket 82, when locked in its extended position, thus functions to internally lock the housing wall 18*b* to the housing body 18*a*, thereby substantially deterring unauthorized entry into the interior of the base housing 18 and access to the operating components housed in the sheet metal chassis 58.

Figure 3:
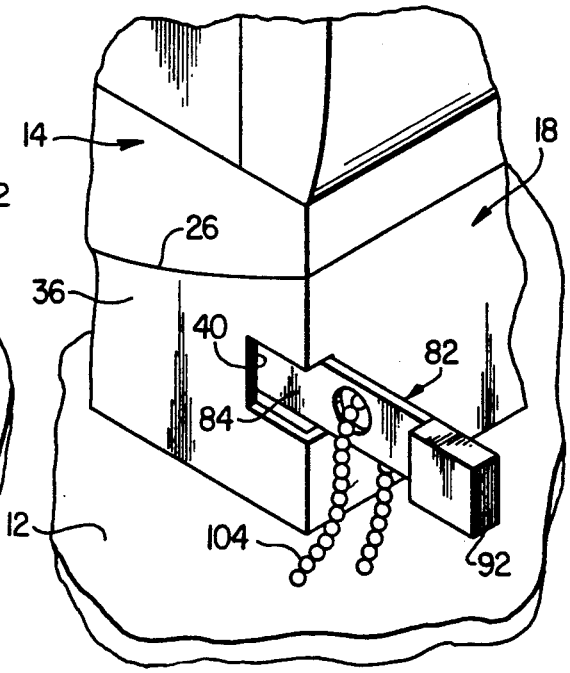
FIG. 3 is a view similar to that in FIG. 2 illustrating another method of utilizing the locking bracket.

The other available function of the locking system—i.e., the provision on computer 10 of a locking attachment point usable to anchor the computer to the table 12—may be brought into play by removing the padlock 102 and, as shown in FIG. 3, passing a locking chain (or a cable) 104 through the bracket aperture 40. In a manner similar to that of padlock 102, the chain 104 prevents the bracket 82 from being moved inwardly to its retracted position in which it unlocks the bottom base housing wall 18*b*. To anchor the computer 10 to the table 12, the chain 104 may be passed through a commercially available locking member (not shown) anchored to the table, and then suitably locked to itself (for example, using the padlock 102).

The foregoing detailed description is to be clearly understood as being given by way of illustration and example only, the spirit and scope of the present invention being limited solely by the appended claims.

What is claimed is:

1. A portable computer comprising:

a housing structure having an exterior wall opening therein;

a wall extending across said opening;

first cooperating means on said housing structure and said wall for removably interlocking said housing structure and said wall;

a security member;

mounting means for captively retaining said security member on said housing structure for movement relative thereto between first and second positions;

second cooperating means on said wall and said security member for locking said wall to said housing structure when said security member is in said first position thereof, and for permitting the normal removal of said wall from said housing structure when said security member is in said second position thereof; and locking means associated with said security member and usable to selectively lock it in said first position thereof, said security member, when in said first position thereof, projecting outwardly from said housing structure, and said locking means including an opening formed in said security member and positioned outwardly of said housing structure when said security member is in said first position thereof, said opening being sized to receive a portion of a locking structure which acts to block the movement of said security member from its first position to its second position.

2. A portable computer comprising:

a housing structure having an exterior wall opening therein;

a wall extending across said opening;

first cooperating means on said housing structure and said wall for removably interlocking said housing structure and said wall;

a security member;

mounting means for captively retaining said security member on said housing structure for movement relative thereto between first and second positions;

second cooperating means on said wall and said security member for locking said wall to said housing structure when said security member is in said first position thereof, and for permitting the normal removal of said wall from said housing structure when said security member is in said second position thereof; and locking means associated with said security member and usable to selectively lock it in said first position thereof, said security member, when in said first position thereof, projecting outwardly from said housing structure, said security member, when in said second portion thereof, having an inner portion that projects into the interior of said housing structure, and an outer portion that is generally flush with an exterior surface portion of said housing structure.

3. A portable computer comprising:

a housing structure having an exterior wall opening therein;

a wall extending across said opening;

first cooperating means on said housing structure and said wall for removably interlocking said housing structure and said wall;

a security member;

mounting means for captively retaining said security member on said housing structure for movement relative thereto between first and second positions;

second cooperating means on said wall and said security member for locking said wall to said housing structure when said security member is in said first position thereof, and for permitting the normal removal of said wall from said housing structure when said security member is in said second position thereof; and locking means associated with said security member and usable to selectively lock it in aid first position thereof, said portable computer further comprising a chassis structure mounted within said housing structure, and said first cooperating means including projections formed on said chassis structure and hook portions formed on said wall and releasably receiving said projections.

4. The portable computer of claim 1 further comprising:

detent means for resiliently engaging said security member and releasably retaining it in either of said first and second positions thereof.

5. The portable computer of claim 1 wherein:

said wall is removable from said housing structure in a first direction, and said second cooperating means include:

a tab portion formed on said wall and extending into the interior of said housing structure, and a portion of said security member positioned to block the movement of said tab portion in said first direction when said security member is in said first position thereof, said portion of said security member being moved out of its blocking relationship with said portion of said security member when said security member is in said second position thereof.

6. A portable computer comprising:

a housing structure having an exterior wall opening therein;

a wall extending across said opening;

first cooperating means on said housing structure and said wall for removably interlocking said housing structure and said wall;

a security member;

mounting means for captively retaining said security member on said housing structure for movement relative thereof between first and second positions;

second cooperating means on said wall and said security member for locking said wall to said housing structure when said security member is in said first position thereof, and for permitting the normal removal of said wall from said housing structure when said security member is in said second position thereof; and locking means associated with said security member and usable to selectively lock it in said first position thereof, said portable computer further comprising a chassis structure mounted within said housing structure and having an outward projection thereon, said housing structure having a second wall opening therein, said security member extending inwardly through said second wall opening, and said mounting means including a plurality of interior projections formed on said housing structure and slidably supporting said security member, and an angled inner end portion of said security member positioned and configured to be brought into abutment with said chassis structure projection when said security member is moved from said second position thereof to said first position thereof.

7. The portable computer of claim 6 further comprising detent means for resliently engaging said security member and releasably retaining it in either of said first and second positions thereof, said detent means including:

spaced apart first and second notches formed in said security member, and a resilient strip portion formed on said chassis structure and having a bent portion positioned to snap into said first when said security member is in said first position thereof, and to snap into said second notch when said security member is in said second position thereof.

8. A portable computer positionable on a support structure such as a table or desk and comprising:

a housing structure;

a security member;

means for captively retaining said security member on said housing structure for movement relative thereto between a first position in which said security member projects outwardly from said housing structure, and a second position in which said security member is retracted into the interior of said housing structure with an outer portion of said security member being generally flush with an exterior surface portion of said housing structure; and opening means formed through a portion of said security member disposed outwardly of said housing structure when said security member is in said first position thereof, said opening means being configured to permit passage therethrough of an elongated flexible locking structure which may be secured to said support structure in a manner locking said security member, and thus said computer, to said support structure.

9. A portable computer comprising a housing structure having first and second openings therein;

a wall extending across said first opening and having a tab portion extending into the interior of said housing structure;

a chassis structure mounted within said housing structure, said chassis structure having a first outward projection disposed thereon and having a resilient strip portion with a bent detent section, and a spaced series of second outward projections;

a spaced series of hook portions formed on said wall and receiving said second projections, said hook portions being operative to preclude removal of said wall from said housing structure except by moving said wall in a first direction relative to said housing structure;

a plurality of interior projections disposed on said housing structure adjacent said first chassis structure projection; and a generally L-shaped security bracket member having:

an elongated body portion extending through said second housing structure opening and slidably supported by said interior housing structure projections for movement relative to said housing structure, through said second housing structure opening, between a first position in which an outer end section of said body portion is positioned outwardly of said housing structure, and a second position in which said body portion is moved into the interior of said housing structure with an outer end of said security bracket member being received in said second housing structure opening and is generally flush with an adjacent exterior surface portion of said housing structure, an angled inner end portion positioned to block movement of said wall tab portion in said first direction when said security tab member is in said first position thereof, and positioned to permit movement of said wall tab portion in said first direction when said security tab member is in said second position thereof, said first chassis structure projection positioned to engage said angled inner end portion of said security bracket member, when said security bracket member is moved to said first position thereof, in a manner preventing further outward movement of said security bracket member body portion through said second housing structure opening, and an opening formed in said outer end section of said security bracket member body portion and through which a portion of a locking structure may be passed when said security bracket member is in said first position thereof to preclude movement of said security bracket member from said first position thereof to said second position thereof.

10. A method of captively retaining a removable wall over an access opening formed in a computer housing, said method comprising the steps of:

interlocking said wall with said housing in a manner permitting said wall to be removed from said housing only by moving said wall in a first direction relative to said housing;

forming a tab on said wall which extends into said housing;

captively retaining a security member on said housing for movement relative thereto between a first position in which said security member has a first portion which projects outwardly of said housing said a second portion disposed within said housing and preventing appreciable movement of said tab in said first direction, to thereby preclude normal removal of said wall from said housing, and a second position in which said first security member portion is moved into said housing and said second security member permits movement of said tab in said first direction in a manner permitting normal removal of said wall from said housing;

forming a locking opening in said first portion of said security member;

moving said security member to said first position thereof; and extending a portion of a locking structure through said locking opening to prevent movement of said security member from said first position thereof to said second position thereof.

11. A method of securing a computer to a larger structure to inhibit theft of the computer, the computer having an exterior housing, said method comprising the steps of:

captively retaining a security member on said housing for movement relative thereto between a first position in which said security member has an outer portion which projects outwardly of said housing, and a second position in which said outer portion of said security member is retracted into said housing;

forming a locking opening in said outer portion of said security member;

moving said security member to said first position thereof;

providing an elongated flexible locking structure which may be extended through said locking opening and attached to said larger structure in a manner captively connecting said security member, and thus said computer, to said larger structure; and extending said locking structure through said locking opening.

* * * * *